US007967065B2

(12) United States Patent
Lutgring

(10) Patent No.: US 7,967,065 B2
(45) Date of Patent: Jun. 28, 2011

(54) CAISSON SYSTEM

(75) Inventor: Keith Thomas Lutgring, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 169 days.

(21) Appl. No.: 11/948,968

(22) Filed: Nov. 30, 2007

(65) Prior Publication Data

US 2009/0142141 A1 Jun. 4, 2009

(51) Int. Cl.
*E21B 17/10* (2006.01)

(52) U.S. Cl. ..... 166/241.6

(58) Field of Classification Search ..... 405/249, 405/224.2; 166/241.6, 241.7
See application file for complete search history.

(56) References Cited

U.S. PATENT DOCUMENTS

| | | | | |
|---|---|---|---|---|
| 2,200,758 | A | 5/1940 | Thaheld | |
| 2,515,796 | A | 7/1950 | Phipps | |
| 3,482,408 | A | 12/1969 | Manning | |
| 3,652,196 | A | 3/1972 | Marion | |
| 4,198,179 | A * | 4/1980 | Pease et al. | 405/224.2 |
| 4,561,802 | A * | 12/1985 | Campo | |
| 4,702,321 | A | 10/1987 | Horton | |
| 4,932,811 | A * | 6/1990 | Folding | |
| 5,147,148 | A | 9/1992 | White | |
| 6,102,626 | A * | 8/2000 | Milberger | |
| 6,422,791 | B1 * | 7/2002 | Pallini et al. | 405/224.2 |

FOREIGN PATENT DOCUMENTS

| | | |
|---|---|---|
| WO | WO91/10806 | 7/1991 |
| WO | WO02/095184 | 11/2002 |

OTHER PUBLICATIONS

PCT International Search Report and Written Opinion mailed Mar. 23, 2009, for international application No. PCT/US2008/084614.

* cited by examiner

*Primary Examiner* — Sunil Singh
(74) *Attorney, Agent, or Firm* — Henry L. "Bud" Ehrlich; Winstead PC

(57) ABSTRACT

An example of a caisson system that surrounds a conductor that extends from a head member positioned above a water surface to below a mud line includes a caisson positioned about the conductor, the caisson having a lowest end; a lower centralizer connected within the caisson proximate the lowest end of the caisson; and a second centralizer connected within the caisson above the lower centralizer relative to the mud line; wherein each centralizer includes a plurality of bow members extending between a first and a second collar, the first collar immovably connected within the caisson and the second collar moveable relative to the first collar, and each bow member curving inward from the caisson defining a bore disposing the conductor.

24 Claims, 3 Drawing Sheets

CAISSON SYSTEM

TECHNICAL FIELD

The present invention relates in general to wellbore operations and more particularly to offshore well installations.

BACKGROUND

It is often desired or necessary to use caissons, or outer tubular members, for conducting engineering operations and the like in water. Caissons may be used to provide a working space, to protect the internal member from external forces, and to protect the external environment from the surrounded area. One example of the use of caissons is in offshore well installations, wherein a drill stem or conductor extends from below the mud line or seafloor to a wellhead position above the water surface. The term conductor is used generally herein to include elongated members that may or may not be tubular as well as various tubular members and strings.

SUMMARY

In view of the foregoing and other considerations, the present invention relates to apparatus, systems, and methods for substantially surrounding an elongated member with a space apart, outer tubular.

Accordingly, an example of a caisson includes an internal centralizer connected to the caisson, the centralizer positioning the caisson relative to the elongated member when the caisson is positioned about the elongated member.

An example of a caisson system that substantially surrounds a conductor that extends from below a mud line to a position above a water surface includes a caisson positioned about the conductor, the caisson having a lowest end positioned proximate to the mud line; a lower centralizer connected within the caisson and positioned about the conductor; and a second centralizer connected within the caisson and positioned about the conductor.

Another example of a caisson system that surrounds a conductor that extends from a head member positioned above a water surface to below a mud line includes a caisson positioned about the conductor, the caisson having a lowest end; a lower centralizer connected within the caisson proximate the lowest end of the caisson; and a second centralizer connected within the caisson above the lower centralizer relative to the mud line; wherein each centralizer includes a plurality of bow members extending between a first and a second collar, the first collar immovably connected within the caisson and the second collar moveable relative to the first collar, and each bow member curving inward from the caisson defining a bore disposing the conductor.

An example of a method of positioning a caisson about a conductor that extends from a head member positioned above a water surface through a mud line includes the steps of providing a caisson having a lower end, a lower centralizer positioned proximate to the lower end, and a second centralizer positioned a distance above the lower centralizer, each centralizer defining a bore having a static diameter proximate to the outside diameter of the conductor; lowering the caisson, over and about the head member and the conductor; passing the head member through the bore of the lower centralizer as the caisson is lowered; and passing the head member through the bore of the second centralizer as the caisson is lowered to the mud line.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
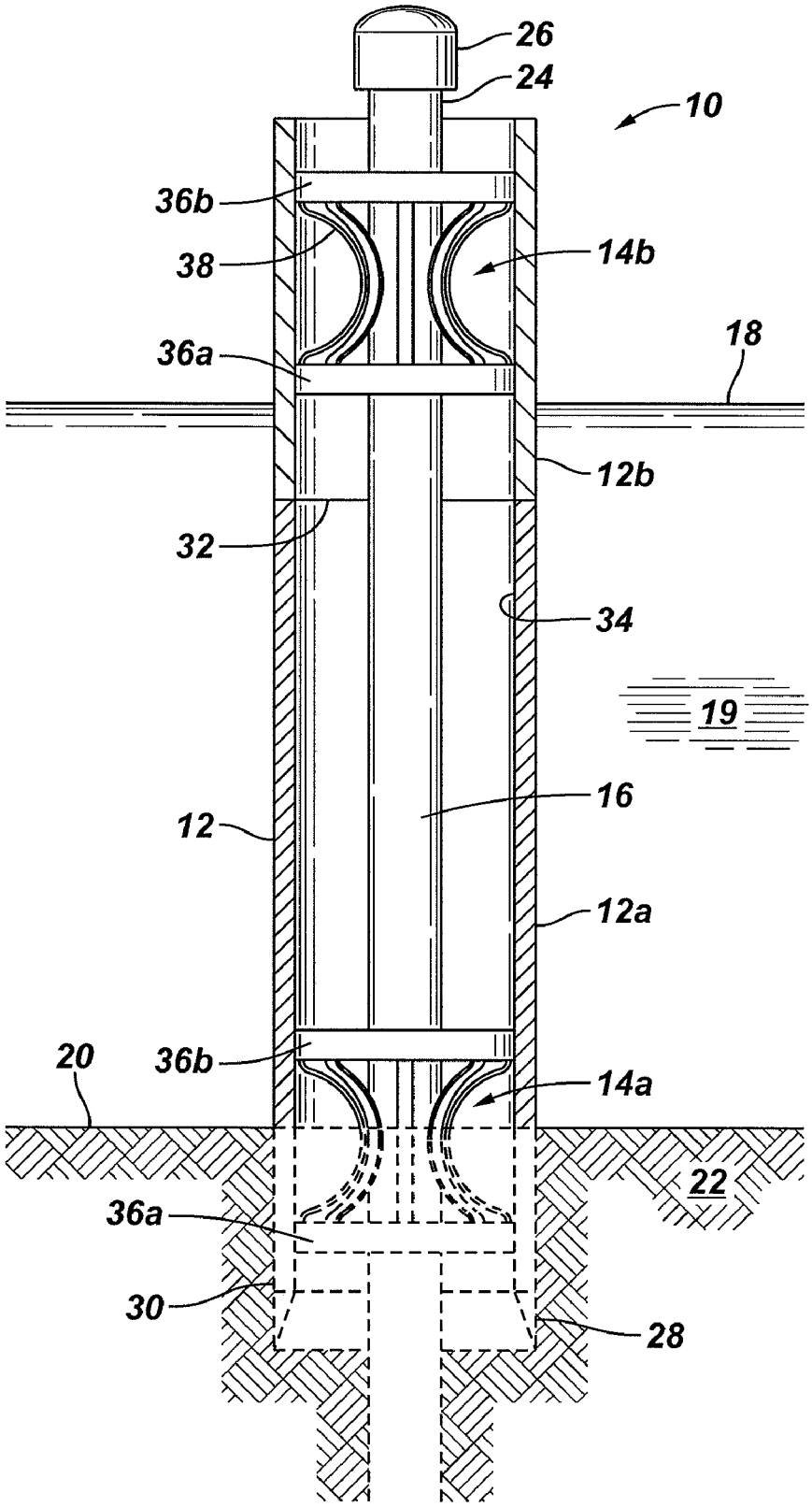
FIG. 1 is a partial cross-sectional view of an example of a caisson system shown in an offshore well installation.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements. Commonly, these terms relate to a reference point as the surface from which drilling operations are initiated, or the wellhead, as being the top point and the total depth of the well being the lowest point, or in relation to the direction of movement from the surface of a body of water to the floor of the body of water.

FIG. 1 is a partial cross-sectional view of an example of a caisson system, generally designated by the numeral 10. Caisson system 10 includes an outer tubular 12, referred to herein as a caisson, and at least one internal centralizer 14. Caisson 12 and centralizer 14 are adapted for positioning and installing caisson 12 substantially concentrically about an elongated member 16.

For the purpose of clarity, caisson system 10 will be described with reference to an offshore well installation, wherein elongated member 16 is a pipe string referred to herein as a conductor. It is noted however, that caisson system 10 may be utilized in various installation in which it is desired to position a first tubular 12 about an inner elongated member, such as a pipe string, piling, or the like.

Conductor 16 is shown extending from above the mean water surface 18 to penetrating the seafloor, or mud line 20, into the earth 22. Positioned at the top end 24 of conductor 16 is a head member 26. Head member 26 may include numerous members or elements such as a blind flange, wellhead, Christmas tree, wellhead protector, wellhead caps and the like. In the illustrated example, head member 26 is a wellhead cap. Head member 26 commonly will have an outside diameter greater than the outside diameter of conductor 16.

Caisson 12 may be constructed from a selection of various materials that are adapted for the specific purpose and environmental conditions of the installation. The length of caisson 12 may vary based on various parameters, such as without limitation the water depth and the soil conditions at and below mud line 20. Commonly, caisson 12 will be constructed of multiple pipe joints that may be connected by various means such as welding and threading.

Caisson 12 may be driven into earth 22 and/or supported by tendons, guy lines, frame structures or other apparatus when installed. Caisson 12 may include a drive shoe 28 formed at or connected to the lowest end 30 of caisson 12 to aid in driving caisson 12 into earth 22. In the illustrated example, caisson 12 is driven into earth 22 as indicated by the hidden lines. Although not shown, caisson 12 may be installed via a drilling rig, be it a vessel or platform, or other lifting and support equipment such as a vessel mounted crane. Commonly, the first or lower joint 12*a* of caisson 12 is positioned over head 26 and then lowered around conductor 16. If needed, a subsequent joint 12*b* is positioned and connected to lower joint 12*a* by a connection 32, shown as a weld in this example. The process is continued until caisson 12 reaches mud line 20 and may then be driven, if desired, into earth 22.

In the examples described herein, one or more centralizers 14 are connected to internal surface 34 to facilitate positioning caisson 12 substantially concentrically about conductor 16. The utilization of centralizers 14 may also control the side-to-side movement of caisson 12 as it is being lowered over conductor 16 in the water column. In the example of FIG. 1, caisson 12 includes at least two centralizers 14. A first or lower centralizer 14*a* is connected within caisson 12 proximate to the lowest end 30 or drive shoe 28. In the illustrated example, lower centralizer 14*a* is connected approximately two feet (0.75 meters) from drive shoe 28. Upper centralizer 14*b* is positioned in this example less than approximately fifty feet (15.25 meters). The spacing between centralizer 14*a* and 14*b* in the example of FIG. 1 may also be described as a distance such that upper centralizer 14*b* engages and may clear head 26 prior to lower centralizer 14*a* enter water 19. The distance between adjacent centralizers 14 may be determined with relation to the lifting equipment (not shown) that is utilized for the installation.

Figure 2:
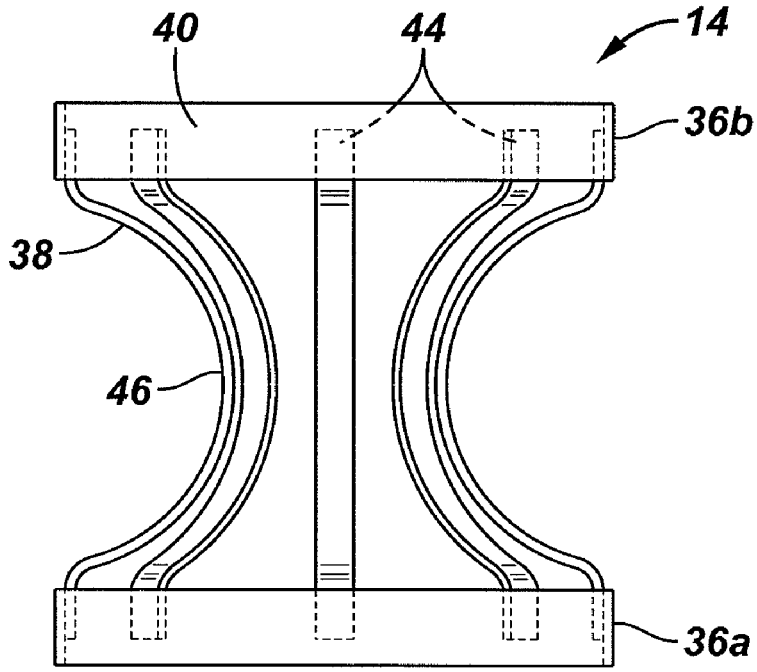
FIG. 2 is a side view of an example of a centralizer shown in isolation.
Figure 3:
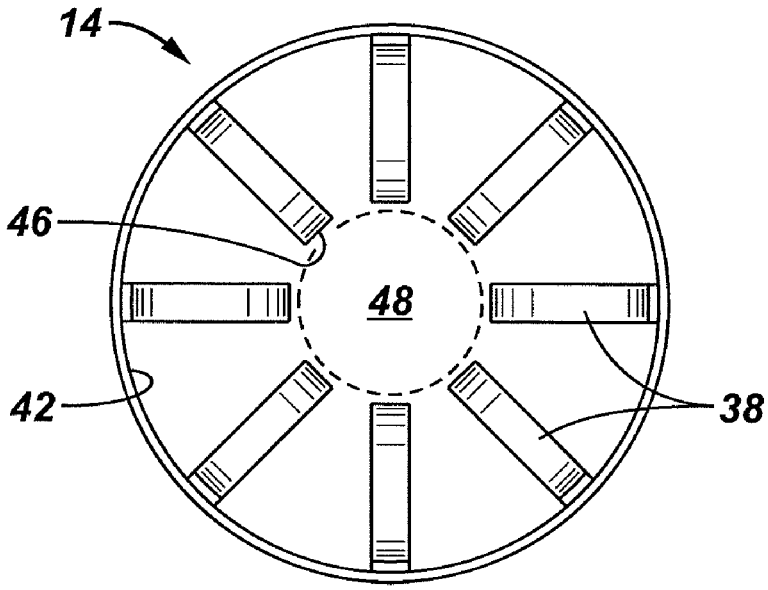
FIG. 3 is an end view of an example of a centralizer shown in isolation.

Refer now to FIGS. 2 and 3, wherein an example of a centralizer 14 is described. Centralizer 14 is described herein generally as a catenoid shaped member. Centralizer 14 shown in FIGS. 2 and 3 includes a pair of collars 36 and multiple bow shaped arcuate members 38. Collars 36 are identified herein as a lower collar 36*a* and an upper collar 36*b* for purposes of description in association with various examples of centralizer 14. Collars 36 are circular members having an outer surface 40 and an inner surface 42. Outer surface 40 defines an outside diameter of both collar 36 and centralizer 14. In the illustrated examples, collars 36 are constructed as a unitary member.

Bow members 38 are constructed of a durable, flexible or spring-like material such as steel or other durable metal. Each bow member 38 in FIGS. 2-3 has opposing ends 44 that are connected to opposing collars 36. Ends 44 may be connected to collars 44 for example by welding, bolts, tabs, or any other suitable means of connecting. In the illustrated and described examples opposing ends 44 are welded to the interior surface 42 of collars 36.

Bow members 38 are described herein as being concaved members, wherein ends 44 of each member and collars 36 provide an outside diameter. Each member 38 in FIGS. 2-3 curves inward relative to its ends 44 and collars 36 to an apex 46. Bow members 38 in FIGS. 2-3 are spaced about collars 36 such that the apexes 46 substantially define a bore 48, indicated by the dashed line, having a desired static diameter, such as proximate to or less than the outside diameter of conductor 16. Static diameter refers to the diameter of bore 48 when bow members are in the relaxed state and not in a biased state. A dynamic diameter may be the diameter that bore 48 may be expanded to by flexing, or extending of the bow members. Bow members 38, and thus centralizer 14, may be flexed so as to expand bore 48 from it static diameter to pass a larger diameter element, such as head member 26, by placing weight on members 38.

Referring now to FIGS. 1-3, a description of an example of a caisson system 10 is described. In a first example, caisson 12 is substantially assembled, possibly in sections, prior to arriving at the well installation or minimally prior to rigging up for placement of caisson 12. Dimensions of various elements of the well installation are obtained. Examples of dimensions include the diameter of conductor 16, distance from head 26 to mud line 20, water 19 depth, and the outside diameters of head 26, blind flanges, base-plates, and other elements that may be connected in or to conductor 16.

Based on the obtained dimensions, centralizer 14 may be constructed such that bore 48 is sized to dispose and contact conductor 16. For example, the diameter of bore 48 may be less than the outside diameter of conductor 16 or greater than the outside diameter of conductor 16. Centralizers 14 are then positioned inside of caisson 12 so that bore 48 is substantially concentrically aligned within caisson 12. Centralizers 14 are attached within caisson 12 by connecting one of the two collars 36 to caisson 12. Means for connecting such as bolting, tack welding, cementing and the like may also be utilized for the secure connection of centralizer 14 to caisson 12. In the example illustrated in FIGS. 2 and 3 only one collar 36 is securely, and immovably, connected to caisson 12 to facilitate the flexing of members 38 and the expansion of bore 48 so as to pass centralizer 14 over various elements such as head 26 and still engage conductor 16 as desired.

In the illustrated example, first or lower centralizer 14*a* is positioned within first caisson joint 12*a* proximate to drive shoe 28. Lower collar 36*a*, closest to drive shoe 28, is immovably connected to inner surface 34 by welding. Second collar 36*b*, the collar distal to drive shoe 28 in this example, is free to move relative to first collar 36*a* permitting the flexing of bow members 38. Second collar 36*b*, may be floating or connected to caisson 12 in a manner to allow longitudinal movement relative to first collar 36*a* as shown by the arrow in FIG. 4.

A second centralizer 14*b* is connected in caisson 12 in a similar fashion as the first centralizer, with one of the collars moveable relative to the other collar. In the described examples, the second centralizer 14*b* is spaced from the first centralizer 14*a* a distance such that second centralizer 14*b* is in a disposed over and gripping position on conductor 16 proximate to or prior to first centralizer 14*a* passing through water level 18 during installation. In some examples first and second centralizers 14 may be connected in the same joint of caisson 12. In the illustrated example, second centralizer 14*b* is positioned and connected within a different joint of caisson 12 from the position of first centralizer 14*a*.

In installation, first caisson joint 12*a* is positioned over conductor 16 and lowed such that head 26 is positioned at bore 48. Lowering continues as head 26 forces bow members 38 to flex, one collar 36 moving relative to the other secured collar 36, allowing centralizer 14*a* to pass head 26. Second caisson joint 12*b* is then positioned and connected to first joint 12*a* at connection 32. It is noted, that one or more joints of caisson may be connected such that it may be run in caisson stands. Second centralizer 14*b* is lowered over head 26 in this example prior to first centralizer 14*a* passing into water 19. The pair of centralizers 14 substantially center conductor 16 relative to caisson 12 and resist lateral movement of caisson 12 when it is being lowered to mud line 20. Once drive shoe 28 encounters mud line 20 it may be driven into earth 22 as desired.

It is noted that various alterations other than those shown and described may be utilized without departing from the scope of the present invention. For example, as noted above either of the top or lower collar, relative to the lowest end of the caisson, may be immovably secured to the caisson. The moveable collar may be left unsecured and free of connection from caisson 12 or may be connected so as to be moveable longitudinally relative to the secured collar. Moveable connections such as sliding sleeves, tongue and track, and the like may be utilized. In another example, centralizers 14 may not include collars 36, but may have ends 44 connected to the inner wall of caisson 12 in the functional manner described in the examples.

Figure 4:
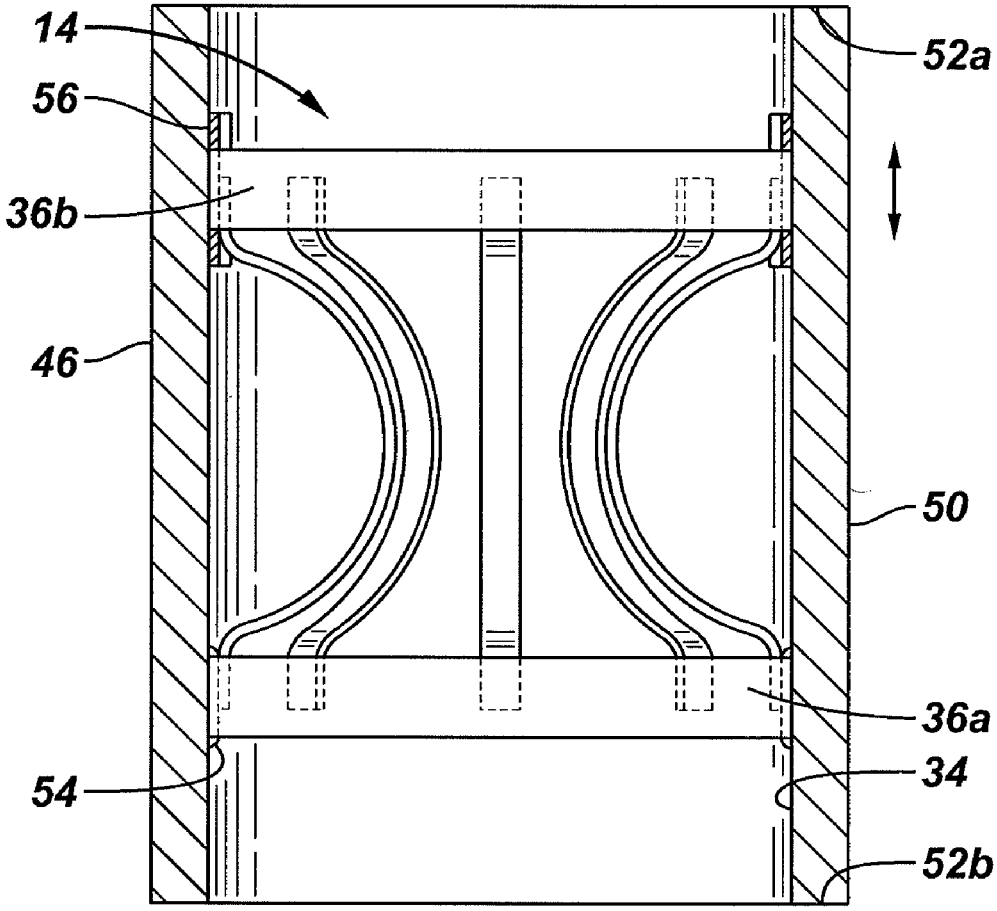
FIG. 4 is a side view of another example of a centralizer shown in a centralizer sub configuration.

Another example of an internal centralizer 14 is described with reference to FIG. 4. It is noted that this example of centralizer 14, provides the ability of maintaining internal centralizers 14 in stock for ease of construction of systems 10. In FIG. 4, centralizer 14 is configured as a sub that may be connected within a caisson 12 (FIG. 1). Centralizer 14 further includes an outer tubular section 50 that may be constructed of the same material and have the same dimensions as caisson 12. Tubular section 50 has opposing ends 52*a*, 52*b* that may be adapted (welding, threading, etc.) for connecting within a tubular string such as caisson 12.

In this example collar 36*a* is the immovably secured collar, and is shown connected by welds 54 to inner surface 34. Collar 36*b* is movable relative to collar 36*a*. In the example illustrated in FIG. 4, moveable collar 36*b* is moveably connected to tubular 50 by a connection mechanism 56 illustrated as a rail member. It is understood, that centralizer 14 of FIG. 4 may be utilized in the manner described above and provides ease in constructing a caisson 12 or altering a caisson assembly at the well installation.

From the foregoing detailed description of specific embodiments of the invention, it should be apparent that an internal centralizer, caisson system, and method of assembly and installation that are novel have been disclosed. Although specific examples have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A caisson comprising an internal centralizer connected to the caisson, the centralizer comprising a catenoid shaped member defining a bore having an expandable diameter to dispose a conductor that extends from below a mud line to above a water surface and to position the caisson about the conductor.

2. The caisson of claim 1, wherein the internal centralizer includes a plurality of bow members curving inward from the caisson.

3. The caisson of claim 2, wherein each of the bow members curves inward to an apex and the plurality of apexes defining the bore.

4. The caisson of claim 2, wherein each bow has an end immovably connected with the caisson and an opposing end that is longitudinally moveable in relation to the immovably connected end.

5. The caisson of claim 1, wherein the internal centralizer comprises:

a first and a second collar; and a plurality of bow members extending between the first and the second collars, the bow members curving inward from the caisson defining the bore.

6. The caisson of claim 5, wherein the first collar is immovably connected to the caisson and the second collar is moveable relative to the first collar, wherein longitudinal movement of the second collar alters the diameter of the bore.

7. A caisson system that substantially surrounds a conductor that extends from below a mud line to a position above a water surface, the system comprising:

a caisson positioned about the conductor, the caisson having a lowest end positioned proximate to the mud line;

a lower centralizer connected within the caisson and positioned about the conductor, the lower centralizer comprising a catenoid shaped member defining a bore disposing the conductor, the bore having an expandable diameter; and a second centralizer connected within the caisson and positioned about the conductor, the second centralizer comprising a catenoid shaped member defining a bore disposing the conductor, the bore having an expandable diameter.

8. The system of claim 7, wherein the second centralizer is positioned above the lower centralizer a distance that is less than or equal to a distance from the water level to a point below a head member that is connected to the conductor.

9. The system of claim 7, wherein each of the centralizers includes a plurality of bow members curving inward from the caisson and in contact with the conductor.

10. The system of claim 9, wherein each bow has an end immovably connected with the caisson and an opposing end that is longitudinally moveable in relation to the immovably connected end.

11. The system of claim 7, wherein for each of the centralizers, one end of the centralizer is immovably connected to the caisson and the other end is longitudinally moveable relative to the immovably connected end, wherein longitudinal movement of the moveable end changes the diameter of the bore.

12. The system of claim 7, wherein the lowest end of the caisson is positioned below the mud line.

13. A caisson system that surrounds a conductor that extends from a head member positioned above a water surface to below a mud line, the system comprising:

a caisson positioned about the conductor, the caisson having a lowest end positioned below the mud line;

a lower centralizer connected within the caisson proximate the lowest end of the caisson; and a second centralizer connected within the caisson above the lower centralizer relative to the mud line; wherein each centralizer includes a plurality of bow members extending between a first collar and a second collar, the first collar immovably connected within the caisson and the second collar moveable relative to the first collar, and each bow member curving inward from the caisson defining a bore disposing the conductor, wherein the bore is expandable from a static diameter proximate to the outer diameter of the conductor to pass the head member through the bore.

14. A method of positioning a caisson about a conductor that extends from a head member positioned above a water surface through a mud line, comprising:

lowering a caisson over and about the head member and the conductor, wherein the caisson comprises a lower end, a lower centralizer positioned inside of the caisson proximate to the lower end and a second centralizer positioned inside of the caisson a distance above the lower centralizer, each centralizer defining a bore having a static diameter proximate to the outside diameter of the conductor;

expanding the diameter of the bore of the lower centralizer to pass the head member through the bore of the lower centralizer as the caisson is lowered; and expanding the diameter of the bore of the second centralizer to pass the head member through the bore of the second centralizer as the caisson is lowered.

15. The method of claim 14, wherein expanding the diameter of the bore of the lower centralizer comprises flexing the lower centralizer.

16. The method of claim 15, wherein the lower centralizer is flexed by the weight of the caisson acting on the lower centralizer.

17. The method of claim 14, wherein each centralizer comprises a substantially catenoid shaped, flexible member forming the bore.

18. The method of claim 17, wherein one end of each of the centralizers is immovably connected to the caisson and an opposing end of each of the centralizers is moveable relative to the immovably connected end.

19. The method of claim 14, wherein the head member is passed through the second centralizer before the lower centralizer is lowered through the water surface.

20. The method of claim 19, wherein each centralizer comprises a substantially catenoid shaped, flexible member forming the bore.

21. The method of claim 20, wherein one end of each of the centralizers is immovably connected to the caisson and an opposing end of each of the centralizers is moveable relative to the immovably connected end.

22. The method of claim 14, wherein each centralizer includes a plurality of bow members extending between a first and a second collar, the first collar immovably connected within the caisson and the second collar longitudinally moveable relative to the first collar, and each bow member curving inward from the caisson to define the bore.

23. The method of claim 22, wherein the head member is passed through the second centralizer before the lower centralizer is lowered through the water surface.

24. The method of claim 14, further comprising driving the lower end of the caisson below the mud line.

* * * * *